US006505030B1

(12) United States Patent
Santiago et al.

(10) Patent No.: US 6,505,030 B1
(45) Date of Patent: Jan. 7, 2003

(54) PRE-FUSER TRANSPORT ASSEMBLY FOR HANDLING A VARIETY OF SHEETS, AND A REPRODUCTION MACHINE HAVING SAME

(75) Inventors: Luis A. Santiago, Rochester, NY (US); Kara L. Bosco, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/935,324

(22) Filed: Aug. 23, 2001

(51) Int. Cl.[7] ..... G03G 15/16
(52) U.S. Cl. ..... 399/389; 399/397
(58) Field of Search ..... 399/124, 388, 399/389, 397

(56) References Cited

U.S. PATENT DOCUMENTS 3,780,503 A * 12/1973 Smith ..... 55/418
4,992,835 A * 2/1991 Matsuzaka ..... 399/124
5,294,965 A * 3/1994 May ..... 399/400

* cited by examiner

*Primary Examiner*—Quana M. Grainger
(74) *Attorney, Agent, or Firm*—Tallam I. Nguti

(57) ABSTRACT

A pre-fuser sheet transport assembly includes (a) an endless belt having vacuum apertures therethrough and being trained about a plurality of rollers including a drive roller; (b) a first plate located under the endless belt and including first holes formed therethrough having a first pattern, and a first size each; (c) a vacuum device for sucking air through the apertures in the endless belt and through the first pattern of the first holes in the first plate; (d) a second plate assembly including a second plate located under the first plate and including second holes having a second pattern and a second size each, the second plate being moveable laterally relative to the first plate; and (e) control apparatus for detecting and adjusting a position of the second plate relative to the first plate, and responsive to a change in a measured parameter of the copy sheet, the control apparatus including a mechanism for controllably adjusting a degree of overlap between the first holes and the second holes, thereby adjustably controlling vacuum pressure being applied to the copy sheet carrying an unfused toner image and being transported to the fuser.

18 Claims, 4 Drawing Sheets

PRE-FUSER TRANSPORT ASSEMBLY FOR HANDLING A VARIETY OF SHEETS, AND A REPRODUCTION MACHINE HAVING SAME

BACKGROUND OF THE INVENTION

The present invention relates generally to electrostatographic reproduction machines, and more particularly, concerns such a machine having a pre-fuser transport assembly for handling a wide variety of sheet weights and sizes.

In a typical toner image reproduction machine, for example an electrostatographic printing process machine, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document.

After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

The foregoing generally describes a typical black and white electrostatographic printing machine. With the advent of multicolor electrophotography, it is desirable to use an architecture which comprises a plurality of image forming stations. One example of the plural image forming station architecture utilizes an image-on-image (IOI) system in which the photoreceptive member is recharged, reimaged and developed for each color separation. This charging, imaging, developing and recharging, reimaging and developing, all followed by transfer to paper, is done in a single revolution of the photoreceptor in so-called single pass machines, while multi-pass architectures form each color separation with a single charge, image and develop, with separate transfer operations for each color.

In either case, the toner image ordinarily is transferred unfused onto a copy sheet of paper, which is then picked up by a transport mechanism (a pre-fuser transport) for delivery to a fuser assembly where the toner is heated and fused to make a finished copy.

Conventional or existing pre-fuser transport mechanisms typically use rotating belts stretched between a drive shaft and an idler shaft with perforations in the belts that allow vacuum pressure from a blower to be drawn through holes in a plate below the belts, and through the belts to the sheet. The vacuum pressure assists each sheet of paper that has an image on it via electrically charged toner particles, to be pulled off the photoreceptor and acquired on the pre-fuser transport, without disturbing the unfused image on the sheet, especially in the transfer zone. The sheet is then transported and delivered to the fuser module where the toner particles are heated and pressure-fused to the sheet.

The problem with this design is that different paper weights and sizes as well as the amount of paper curl, require different amounts of air pressure for helping strip the sheet off the photoreceptor after image transfer.

Therefore, there is a need for a pre-fuser transport design that allows for varying the air pressure on the sheet responsive to sensed sheet parameters such as weight and size.

SUMMARY OF THE INVENTION

In accordance with one aspect of the present invention, there is provided a pre-fuser sheet transport assembly includes (a) an endless belt having vacuum apertures therethrough and being trained about a plurality of rollers including a drive roller; (b) a first plate located under the endless belt and including first holes formed therethrough having a first pattern, and a first size each; (c) a vacuum device for sucking air through the apertures in the endless belt and through the first pattern of the first holes in the first plate; (d) a second plate assembly including a second plate located under the first plate and including second holes having a second pattern and a second size each, the second plate being moveable laterally relative to the first plate; and (e) control apparatus for detecting and adjusting a position of the second plate relative to the first plate, and responsive to a change in a measured parameter of the copy sheet, the control apparatus including a mechanism for controllably adjusting a degree of overlap between the first holes and the second holes, thereby adjustably controlling vacuum pressure being applied to the copy sheet carrying an unfused toner image and being transported to the fuser.

BRIEF DESCRIPTION OF THE DRAWINGS

The foregoing and other features of the instant invention will be apparent and easily understood from a further reading of the specification, claims and by reference to the accompanying drawings in which:

DETAILED DESCRIPTION OF THE INVENTION

While the present invention will be described hereinafter in connection with a preferred embodiment thereof, it should be understood that it is not intended to limit the invention to that embodiment. On the contrary, it is intended to cover all alternatives, modifications and equivalents as may be included within the spirit and scope of the invention as defined in the appended claims.

Figure 1:
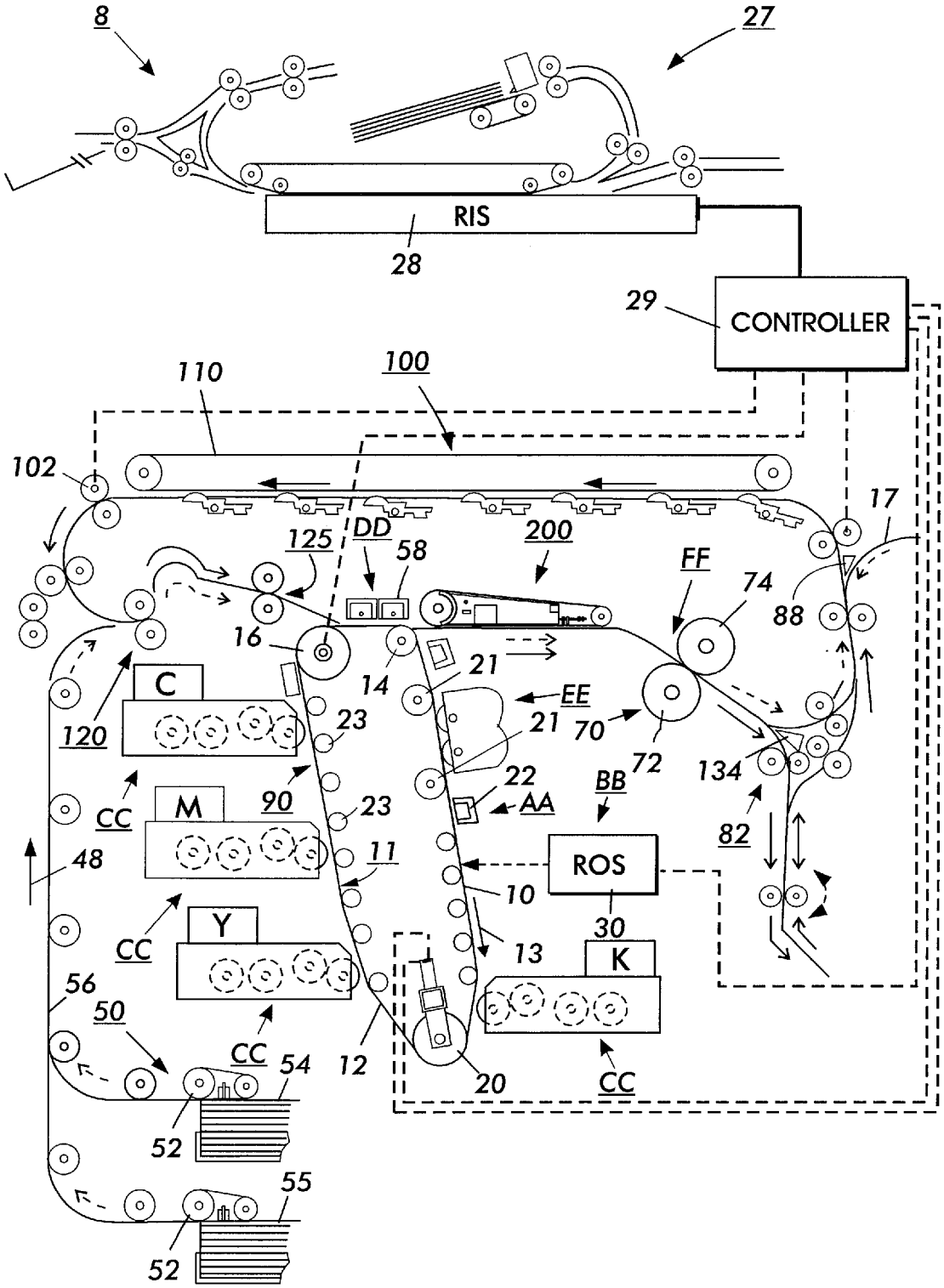
FIG. 1 is a schematic elevational view of an exemplary electrostatographic reproduction machine depicting the pre-fuser sheet transport assembly of the present invention.

Referring first to FIG. 1, it schematically illustrates an electrostatographic reproduction machine 8 which generally employs a photoconductive belt 10 mounted on a belt support module 90. Preferably, the photoconductive belt 10 is made from a photoconductive material coated on a conductive grounding layer which, in turn, is coated on an anti-curl backing layer. Belt 10 moves in the direction of arrow 13 to advance successive portions sequentially through various processing stations disposed about the path of movement thereof. Belt 10 is entrained as a closed loop 11 about stripping roll 14, drive roll 16, idler roll 21, and backer rolls 23.

Initially, a portion of the photoconductive belt surface passes through charging station AA. At charging station AA, a corona generating device indicated generally by the reference numeral 22 charges the photoconductive belt 10 to a relatively high, substantially uniform potential.

As also shown the reproduction machine 8 includes a controller or electronic control subsystem (ESS) 29 which is preferably a self-contained, dedicated mini-computer having a central processor unit (CPU), electronic storage, and a display or user interface (UI). The ESS 29, with the help of sensors and connections, can read, capture, prepare and process image data and machine status information.

Referring again to FIG. 1, at an exposure station BB, the controller or electronic subsystem (ESS), 29, receives the image signals from RIS 28 representing the desired output image and processes these signals to convert them to a continuous tone or gray scale rendition of the image which is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. At exposure station BB, the ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image through development stations CC, which include four developer units as shown, containing CMYK color toners, in the form of dry particles. At each developer unit the toner particles are appropriately attracted electrostatically to the latent image using commonly known techniques.

With continued reference to FIG. 1, after the electrostatic latent image is developed, the toner powder image present on belt 10 advances to transfer station DD. A print sheet 48 is advanced to the transfer station DD, by a sheet feeding apparatus 50. Preferably, sheet feeding apparatus 50 includes a corrugated vacuum feeder (TCVF) assembly 52 (of the present invention) for contacting the uppermost sheet of stack 54, 55. TCVF 52 acquires, senses the basis weight of each sheet (as described below), and advances the sheet from stack 54, 55 to vertical transport 56. Vertical transport 56 directs the advancing sheet 48 of support material through feed rolls 120 into registration transport 125, then past image transfer station DD to receive an image from photoreceptor belt 10 in a timed sequence so that the toner powder image formed thereon contacts the advancing sheet 48 at transfer station DD. Transfer station DD includes a corona-generating device 58, which sprays ions onto the backside of sheet 48. This attracts the toner powder image from photoconductive surface 12 to sheet 48. After transfer, sheet 48 continues to move in the direction of arrow 60 where it is picked up by the pre-fuser transport assembly 200 of the present invention (to be described in detail below) for transport to fusing station FF.

Fusing station FF includes a fuser assembly indicated generally by the reference numeral 70 which permanently affixes the transferred toner power image to the copy sheet. Preferably, fuser assembly 70 includes a heated fuser roller 72 and a pressure roller 74 with the powder image on the copy sheet contacting fuser roller 72. The pressure roller is crammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 88 either allows the sheet to move directly via output 17 to a finisher or stacker, or deflects the sheet into the duplex path 100. Specifically, the sheet when to be directed into the duplex path 100, is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station DD and fuser 70 for receiving and permanently fixing the side two image to the backside of that duplex sheet, before it exits via exit path 17.

After the print sheet is separated from photoconductive surface 12 of belt 10, the residual toner/developer and paper fiber particles adhering to photoconductive surface 12 are removed therefrom at cleaning station EE. Cleaning station EE includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

Figure 2:
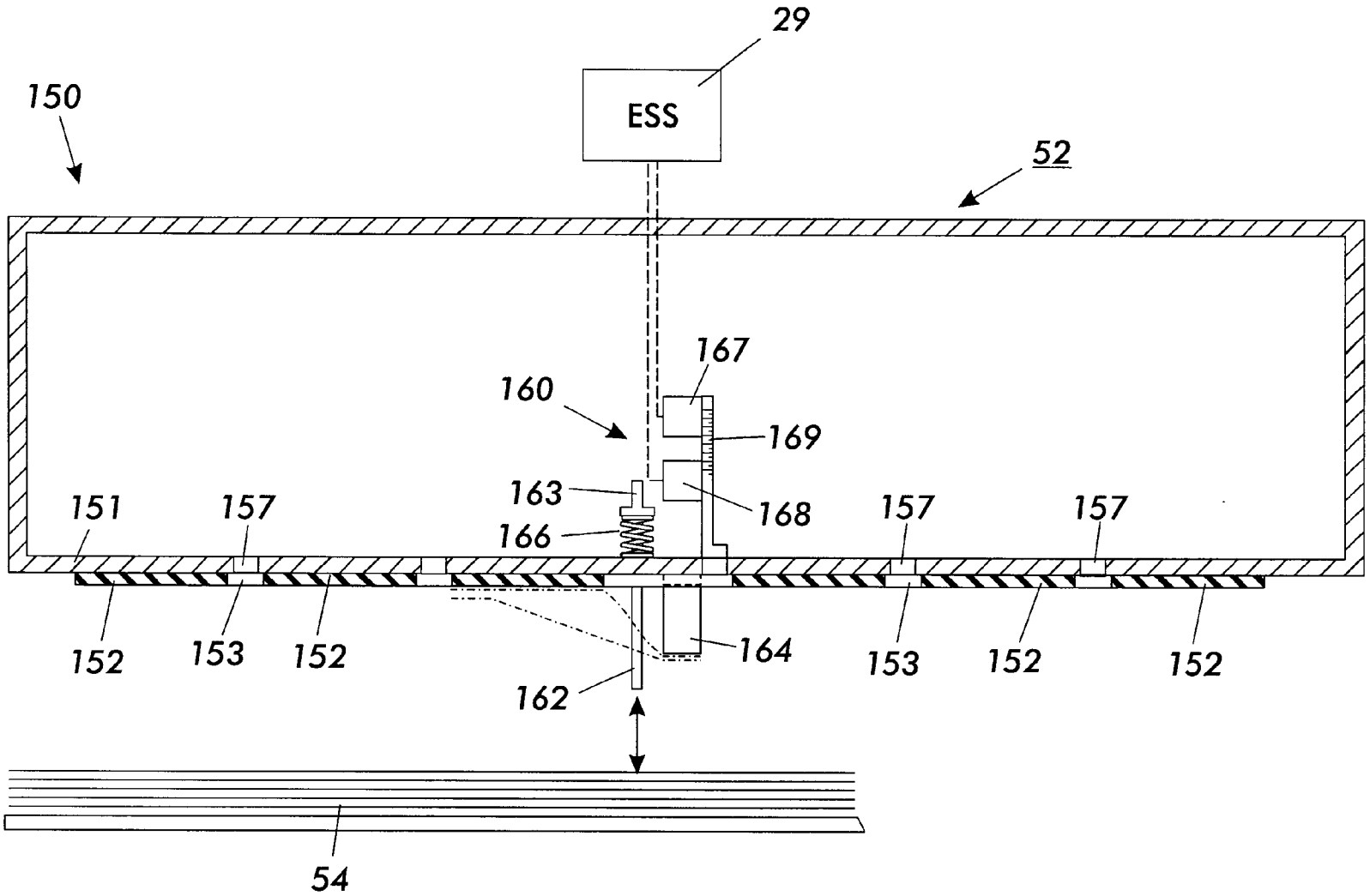
FIG. 2 illustrates an end-view of the plenum portion of a copy sheet feeder such as a top corrugated vacuum feeder (TCVF) including an example of a means for detecting paper basis weight of copy sheets as used in the present invention.

Referring now to FIG. 2, the TCVF 52 is illustrated in detail and includes a feeder plenum 150 that is located above the stack 54, 55. The feeder plenum 150 includes a plate 151 defining a cavity which may be evacuated through openings 157, thereby forming a pressure differential. Between the outside and inside of the plenum. The floor of the feeder plenum, plate 150, includes a series of the small openings 157. The difference in pressure between the inside of the feeder plenum 150 and the outside of the feeder plenum 150 forces the copy sheet 48 from the stack 54, 55 towards the outer surface of the bottom of feeder plenum 150. A series of feeder belts 152 run along the outside surface of the plenum 150 in a direction for feeding a sheet from the stack 54, 55 to the unit 56. The feed belts 152 may include openings 153 which cooperate with the openings 157 in the vacuum plenum 150.

The TCVF 52 may include an air knife (not shown) that has a plurality of air jet openings arranged such that the air knife may inject air into the pocket formed between the sheet pulled up (pulled down in a BVCF) against the feed belts 152 and the sheets below it in the stack. Thus, by providing an air cushion or bearing between the stack and the top sheet, the force necessary to remove the sheet sought to be acquired from the stack is minimized thereby reducing the likelihood of removing other sheets from the stack (i.e., to reduce multi-feeds).

In according to an aspect of the present invention, the TCVF assembly 52 includes a sheet parameters detecting device 160 for detecting significant paper properties such as basis weight, as well as sheet size as is well known. As described and claimed below, the pre-fuser assembly 200 of the present invention then selects and adjusts appropriate air parameters such as plenum pressure, plenum flow, based on the detected paper properties.

FIG. 2 illustrates an example of a sheet parameters detecting device 160 for detecting the basis weight of a copy sheet. As shown, the feeder plenum 150 includes a spring-loaded plunger 162 is disposed within a feedhead corrugator bar 164. The feedhead corrugator bar 164 changes the geometry of (i.e., bends) the sheet forced against it such that any sheets sticking to the acquired sheet to be fed are more easily separated by the air knife.

Both the spring-loaded plunger 162 and the feedhead corrugator bar 164 are positioned normal to the surface of the floor of the feeder plenum 150 and extend downward toward the stack 54, 55 of supply sheets. A spring 166 is disposed between a ledge 163 of the spring-loaded plunger 162 and the bottom inside surface of the feeder plenum 150 such that a first end of the spring 166 is attached to the ledge 163 of the plunger 162 while a second end of the spring 166 is attached to the bottom inside surface of the feeder plenum 150.

When a sheet of copy sheet 48 is forced toward the bottom surface of the feeder plenum 150 by the pressure differential, the sheet will exert an upward force on the plunger due to the bending of -the sheet. Since a relatively heavy weight sheet is stiffer than a normal weight sheet, more force is exerted on the plunger 162 while relatively light weight sheets are more flexible and therefore exert less force on the plunger 162. The plunger is forced upwards against the biasing force of the spring 166 in an amount proportional to the force exerted by the copy sheet. In a preferred embodiment, the plunger is displaced on the order of 5 to 10 mm.

One or more sensors (167, 168) are mounted on a sensor mount (169) such that they can detect the displacement of the plunger. In this embodiment, the sensors are optical sensors having a beam which is broken when the plunger 162 crosses it. In general, "n" sensors can differentiate "n"+1 plunger positions. In the embodiment illustrated in FIG. 2, the two sensors can detect three plunger positions corresponding to three basis weights (see TABLE I).

TABLE I

| | Basis Weight | | |
|---|---|---|---|
| Sensor | Light weight | Medium Weight | Heavy weight |
| 9 Tripped? | | | |
| 10 Tripped? | | | |

Figure 3:
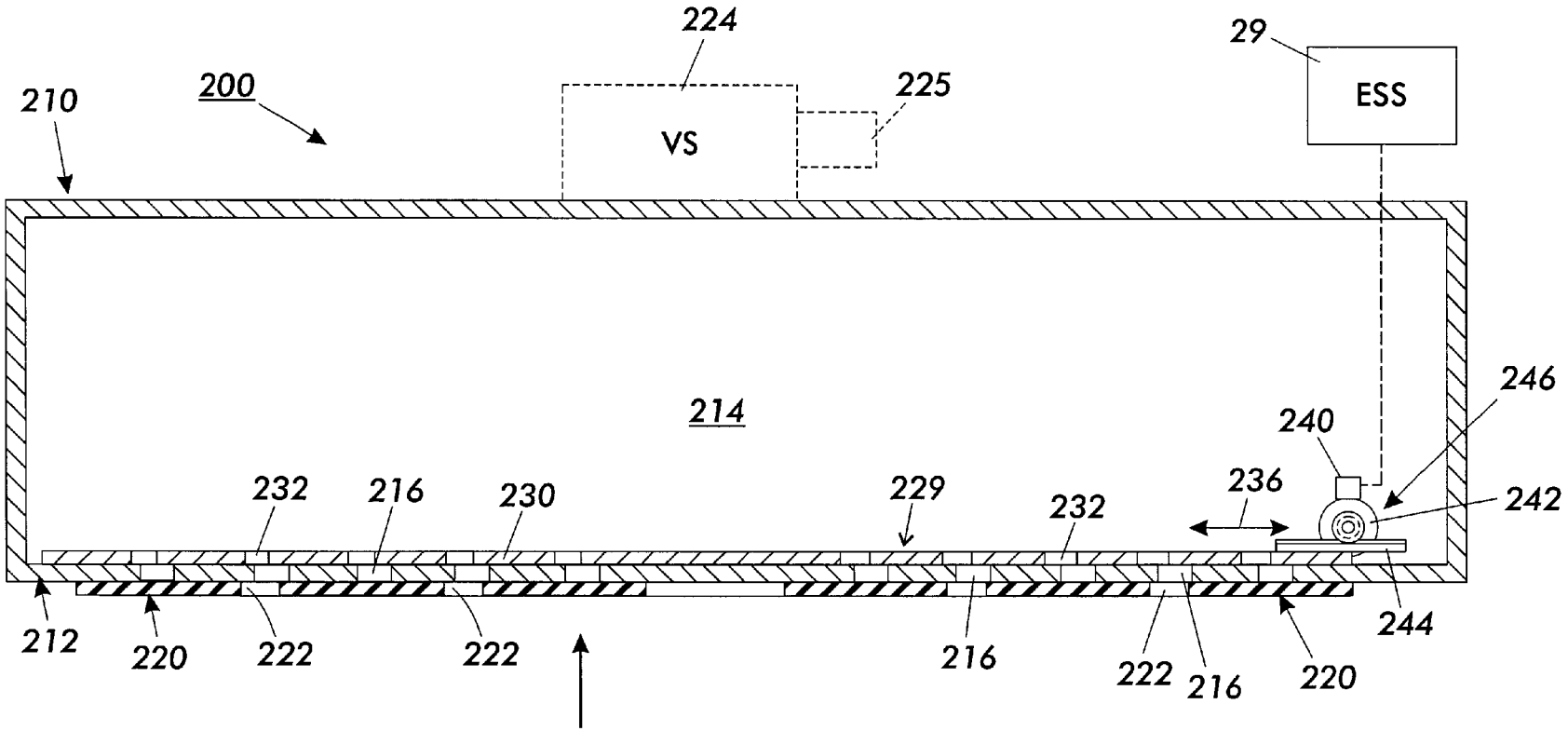
FIG. 3 illustrates the end-view of the pre-fuser sheet transport assembly including the second plate having a series of second holes in accordance with the present invention.
Figure 4:
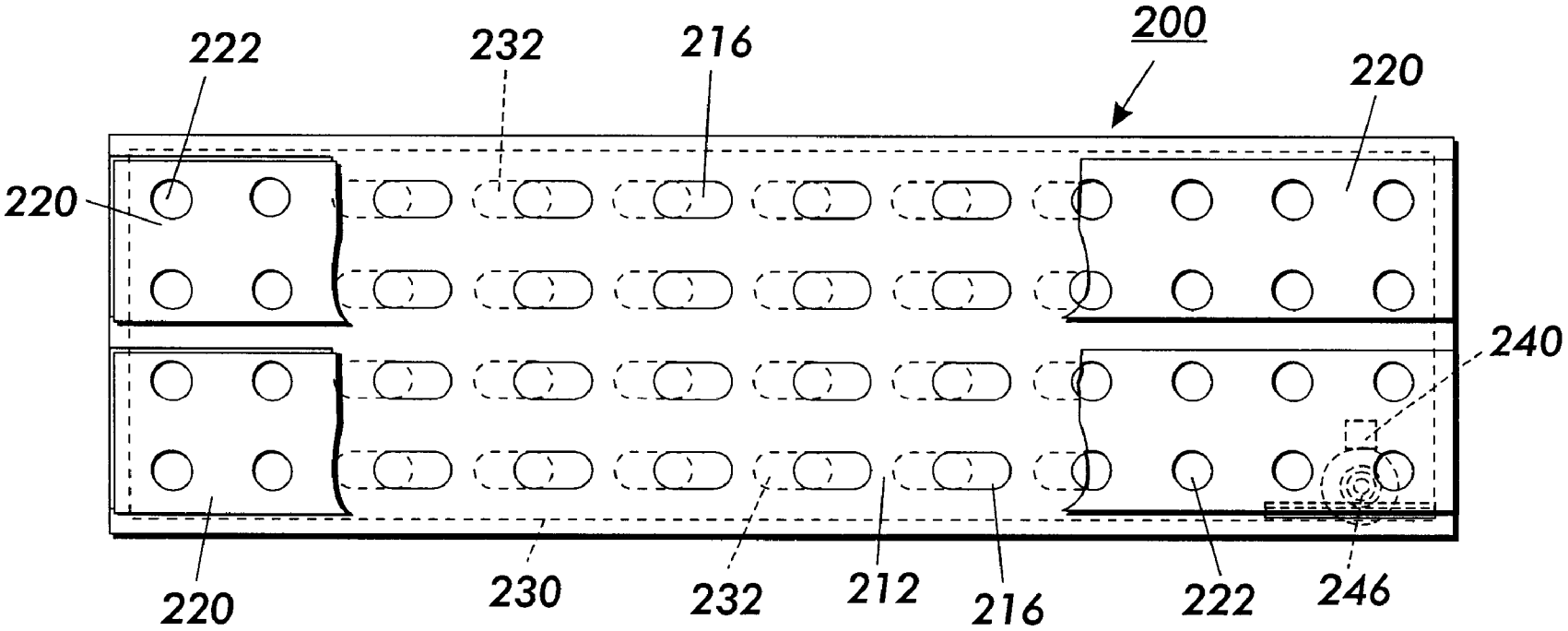
FIG. 4 illustrates a bottom-view of the first and second plates of the pre-fuser sheet transport assembly showing the second and third series of alignable holes in accordance with the present invention.

Referring now to FIGS. 3–4, the pre-fuser transport assembly 200 of the present invention is illustrated in detail. As shown, the pre-fuser transport assembly 200 includes a transport plenum 210 that has a first plate 212 forming the floor and in part defining a cavity 214. The first plate 212 includes a series of first holes 216 having a first size each, and together forming a first pattern 218. The pre-fuser transport assembly 200 also includes a series of transport belts 220 run along the outside surface of the plenum 210, as shown each of the belts 220 includes a series of second holes 222 which cooperate with the series of first holes 216 in the first plate 212. The cavity 214, as is well known, can be evacuated through the series of first holes 216 by a vacuum means 224, thereby forming a pressure differential between the outside and inside of the transport plenum 210. The difference in pressure between the inside and outside of the transport plenum 210 forces the backside of a toner image carrying copy sheet 48 onto the transport belts 220 for transport from the transfer station DD (FIG. 1) towards the fusing station FF.

The transport belts 220 are rotating belts stretched between a drive shaft 226 (FIG. 1) and an idler shaft 228. As pointed out above, the perforations or series of second holes 222 in the belts 220 allow vacuum pressure from vacuum means or blower 224 to be drawn through the first holes 216 in the bottom or first plate 212 and through the belts 220 to the sheet. The vacuum pressure assists the sheet of paper that has an image on it, to be pulled off the photoreceptor and acquired onto the pre-fuser transport assembly 200, without disturbing the unfused image on the sheet, especially in the transfer zone. The sheet is then transported and delivered to the fuser 70 where the toner particles are heated and pressure fused to the sheet.

In accordance with an aspect of the present invention, the surface area or through opening of each of the first holes 216 in the bottom or first plate 212 is adjustable in size. A sliding or second plate 230 is provided and has a series of third holes 232 in it. The series of third holes 232 each have the same size as the holes 216 in the first plate 212. The series of third holes 232 together have a second pattern 234 as that of the first holes 216 in the bottom or first plate 212. As illustrated, the second plate 230 is mounted so that it rests against and is slidable relative to the bottom or first plate 212. As shown, where the pre-fuser transport assembly is located as a top transport device (as shown) the second plate 230 will be located or rest on the upperside of the first plate 212.

Referring in particular to FIGS. 3 and 4, the second plate 230 is located above the bottom or first plate 212, and is movable slidably as shown by the arrows 236, 238 for controlling the overall surface area or through opening of each of the first holes 216. The maximum size of a through hole or opening through each first hole 216 is achieved when the third holes 232 (in the second plate 230) are aligned with the first holes 216 (in the first plate 212). On the other hand, the greater an offset between the third holes 232 and the first holes 216, the narrower the size or area of the resultant through hole or opening of each first hole 216. In accordance with the present invention, by increasing or decreasing the surface area of through opening of each of the first holes 216, one would also responsively increase or decrease the amount of vacuum pressure getting to the sheet 48 on the transport belts 220.

In operation, as an empty sheet of paper 48 is fed by the TCVF 52 passed the sheet parameters detecting device 160, the device 160 can detect sheet size and sheet weight (as described above), and then pass the detected information to the controller 29. Responsively, the controller 29 will then slidably move the second plate 230 relative to the first plate 212 so as to increase or decrease the surface area or through opening of each of the first holes 216 accordingly. As illustrated, the sheet parameters detecting device 160 is located upstream of the pre-fuser transport assembly 200 and is useful for other applications.

As further shown, the pre-fuser transport assembly 200 includes a motor 240 that activates at least one worm gear 242 which is mounted to at least one tab member or feature 244 attached to the sliding or second plate 230. A plural number of worm gears and tab members can be employed accordingly. As the worm gears 242 rotate, the sliding or second plate 230 either increases or decreases the surface area of the through ports or first holes 216 on the bottom or first plate 212. By increasing or decreasing the surface area of the first holes 216, you also increase or decrease the amount of vacuum pressure getting to the acquisition zone. A sheet parameter detecting device 160 detects sheet size and weight, and the controller 29 responsively activates the motor 240 to increase or decrease each through port (or first hole) 216 surface area.

Advantages of the present invention include the fact that there is a wide range of paper weights and sizes that the pre-fuser transport assembly 200 of the present invention can handle. Another advantage is that the sheet parameter detecting device 160 needed for assessing paper size and weight most likely is already in place in the machine and upstream of the pre-fuser assembly for another application such as paper feeding (as described above), timing or registration.

Thus to recapitulize, the pre-fuser sheet transport assembly 200 includes at least one endless belt 220 having vacuum apertures or series of second holes 222 therethrough, that is trained about a plurality of rollers or shafts 226, 228 including a drive roller 226. The pre-fuser transport assembly 200 also includes the first plate 212 located under the endless belt 220 and including a series of first holes 216 therethrough. The series of first holes 216 has a first pattern 218 for example as shown, and a first size each. A vacuum source 224 is provided for sucking air through the vacuum apertures 222 in the endless belt, and through the series of first holes 216 in the first plate 212. The vacuum source 224 includes a variable speed blower and a brushless DC motor 225.

The pre-fuser transport assembly 200 also includes a second plate assembly 229 having a second plate 230 located against the first plate 212. The second plate 230 rests slidably against the first plate 212. The second plate 230 is moveable 236, 238 laterally relative to the first plate 212, and includes the series of third holes 232 having a second pattern 234 as shown, and a second size. The second pattern 234 is the same as the first pattern 218, and the second size is the same as or equal to the first size of the first holes 216. The second plate assembly 229 also includes apparatus 246 for adjusting a position of the second plate 230 relative to the first plate 212, thereby controllably adjusting a degree of overlap between first holes 216 of the first plate and third holes 232 of the second plate. Such a degree of overlap thereby adjustably controls vacuum pressure being applied by the pre-fuser transport assembly to the copy sheet being transported to the fuser 70.

The second plate assembly 229 also includes tab members 244 on the second plate 230, at least one worm gear 242 (a couple of such gears are acceptable) coupled to the tab members 244, and a drive device or motor 240 connected to the controller 29 for responsively driving the at least one worm gear for moving the second plate 230 relative to the first plate 212.

The pre-fuser transport assembly 200 may further include a third plate 248 located inside the endless belt 220 and spaced from the second plate 230, thereby defining an open region or the cavity 214 with the second plate.

As can be seen, there has been provided a pre-fuser sheet transport assembly that includes (a) an endless belt having vacuum apertures therethrough, the endless belt being trained about a plurality of rollers including a drive roller; (b) a first plate located under the endless belt and including first holes formed therethrough having a first pattern, and a first size each; (c) a vacuum means for sucking air through the apertures in the endless belt and through the first pattern of the first holes in the first plate; (d) a second plate assembly including a second plate located under the first plate and including second holes having a second pattern and a second size each, the second plate being moveable laterally relative to the first plate; and (e) control means for detecting and adjusting a position of the second plate relative to the first plate responsive to a change in a measured parameter of the copy sheet, the control means including a means for controllably adjusting a degree of overlap between the first holes and the second holes, thereby adjustably controlling vacuum pressure being applied to the copy sheet carrying an unfused toner image and being transported to the fuser.

While the invention has been described with reference to the structure herein disclosed, it is not confined to the details as set forth and is intended to cover any modification and changes that may come within the scope of the following claims.

What is claimed is:

1. In an electrostatographic reproduction machine including a controller, an image transfer station, means for forming and transferring a toner image unfused onto a copy sheet, and a fuser for fusing the toner image, a pre-fuser sheet transport assembly comprising:

an endless belt having vacuum apertures therethrough, said endless belt being trained about a plurality of rollers including a drive roller;

a first plate located under said endless belt and including first holes therethrough having a first pattern, and a first size each;

a vacuum means for sucking air through said apertures in said endless belt and through said first pattern of said first holes in said first plate;

a second plate assembly including a second plate located under said first plate and including second holes having a second size, said second plate being moveable laterally relative to said first plate;

a third plate located under said endless belt, said third plate being spaced from said second plate and defining an open region with said second plate; and means for detecting and adjusting a position of said second plate relative to said first plate, thereby controllably adjusting a degree of overlap between said first holes and said second holes, and hence adjustably controlling vacuum pressure being applied to the copy sheet carrying an unfused toner image and about to be transported to the fuser.

2. The pre-fuser sheet transport assembly as claimed in claim 1, wherein said second plate rests slidably against said first plate.

3. The pre-fuser sheet transport assembly as claimed in claim 1, wherein said second size is the same as said first size.

4. The pre-fuser sheet transport assembly as claimed in claim 1, wherein said second pattern is the same as said first pattern.

5. The pre-fuser sheet transport assembly as claimed in claim 1, wherein said means for detecting and adjusting a position of said second plate relative to said first plate includes an adjusting means having a worm gear.

6. The pre-fuser sheet transport assembly as claimed in claim 1, wherein said means for detecting and adjusting a position of said second plate relative to said first plate includes a tab member on said second plate.

7. The pre-fuser sheet transport assembly as claimed in claim 1, wherein said vacuum means includes a variable speed blower.

8. The pre-fuser sheet transport assembly as claimed in claim 1, wherein said vacuum means includes a variable speed blower and a brushless DC motor.

9. The pre-fuser sheet transport assembly as claimed in claim 1, wherein said second plate assembly includes said second plate, tab members on said second plate, at least one worm gear coupled to said tab members, and a drive means for driving said at least one worm gear for moving said second plate relative to said first plate.

10. An electrostatographic reproduction machine comprising;

(a) a closed loop belt image bearing member having an imaging surface for carrying a toner image;

(b) a copy sheet supply and handling assembly for moving a copy sheet into a toner image transfer relationship with said closed loop belt image bearing member;

(c) imaging devices for forming a toner image on said imaging surface of said closed loop belt image bearing member and transferring the toner image to a copy sheet;

(d) a fuser mechanism for heating fusing said toner image onto said copy sheet; and (e) a pre-fuser sheet transport assembly comprising:

(i) an endless belt having vacuum apertures therethrough, said endless belt being trained about a plurality of rollers including a drive roller, (ii) a first plate located under said endless belt and including first holes therethrough having a first pattern, and a first size each;

a vacuum means for sucking air through said apertures in said endless belt and through said first pattern of said first holes in said first plate;

(iii) detecting means for detecting a sheet property of a copy sheet fed through the image transfer station and thus carrying an unfused toner image and about to be transported to the fuser;

(iv) a second plate assembly including a second plate located under said first plate and including second holes having a second size, said second plate being moveable laterally relative to said first plate;

(v) a third plate located under said endless belt, said third plate being spaced from said second plate and defining an open region with said second plate; and (vi) means for detecting and adjusting a position of said second plate relative to said first plate, thereby controllably adjusting a degree of overlap between said first holes and said second holes, and hence adjustably controlling vacuum pressure being applied to the copy sheet carrying an unfused toner image and about to be transported to the fuser.

11. The electrostatographic reproduction machine as claimed in claim 10, wherein said second plate rests slidably against said first plate.

12. The electrostatographic reproduction machine as claimed in claim 10, wherein said second size is the same as said first size.

13. The electrostatographic reproduction machine as claimed in claim 10, wherein said second pattern is the same as said first pattern.

14. The electrostatographic reproduction machine as claimed in claim 10, wherein said detecting means for detecting a sheet property comprises a sensor for detecting sheet size.

15. The electrostatographic reproduction machine as claimed in claim 10, wherein said detecting means for detecting a sheet property comprises a sensor for detecting sheet weight.

16. The electrostatographic reproduction machine as claimed in claim 10, wherein said vacuum means includes a variable speed blower.

17. The electrostatographic reproduction machine as claimed in claim 10, wherein said vacuum means includes a variable speed blower and a brushless DC motor.

18. The electrostatographic reproduction machine as claimed in claim 10, wherein said second plate assembly includes said second plate, tab members on said second plate, at least one worm gear coupled to said tab members, and a drive means for driving said at least one worm gear for moving said second plate relative to said first plate.

* * * * *